US010315744B2

(12) United States Patent
Garthwaite

(10) Patent No.: US 10,315,744 B2
(45) Date of Patent: Jun. 11, 2019

(54) FIN-BASED DIVER PROPULSION VEHICLE

(71) Applicant: Martin Spencer Garthwaite, Bainbridge Island, WA (US)

(72) Inventor: Martin Spencer Garthwaite, Bainbridge Island, WA (US)

( * ) Notice: Subject to any disclaimer, the term of this patent is extended or adjusted under 35 U.S.C. 154(b) by 0 days.

(21) Appl. No.: 15/967,552

(22) Filed: Apr. 30, 2018

(65) Prior Publication Data

US 2018/0312234 A1 Nov. 1, 2018

Related U.S. Application Data

(60) Provisional application No. 62/621,620, filed on Jan. 25, 2018, provisional application No. 62/618,080, filed on Jan. 17, 2018, provisional application No. 62/507,275, filed on May 17, 2017, provisional application No. 62/492,144, filed on Apr. 29, 2017.

(51) Int. Cl.
*B63H 1/36* (2006.01)
*B63C 11/46* (2006.01)

(52) U.S. Cl.
CPC ..... *B63H 1/36* (2013.01); *B63C 11/46* (2013.01); *B63B 2211/04* (2013.01)

(58) Field of Classification Search
CPC ..... B63H 1/36; B63C 11/46; B63B 2211/04
See application file for complete search history.

(56) References Cited

U.S. PATENT DOCUMENTS

| | | | | |
|---|---|---|---|---|
| 3,362,367 | A * | 1/1968 | Rosfelder | B63G 8/26 114/124 |
| 6,138,604 | A * | 10/2000 | Anderson | B63G 8/08 114/332 |
| 6,814,634 | B2 * | 11/2004 | Roberts | B63H 11/08 440/38 |
| 6,835,108 | B1 * | 12/2004 | Gieseke | B63H 1/36 440/14 |
| 7,258,301 | B2 * | 8/2007 | Li | A63B 35/00 244/4 A |
| 7,865,268 | B2 * | 1/2011 | Valdivia y Alvarado | A01K 85/01 114/332 |
| 8,322,296 | B2 * | 12/2012 | Tiraby | B63G 8/001 114/337 |
| 8,323,062 | B2 * | 12/2012 | Bannasch | B63H 1/36 114/332 |
| 9,090,320 | B2 * | 7/2015 | Rufo | F16F 1/025 |
| 9,645,181 | B2 * | 5/2017 | Mimlitch, III | G01R 27/02 |
| 9,937,986 | B1 * | 4/2018 | Oh | B63G 8/001 |
| 2017/0312614 | A1 * | 11/2017 | Tran | H04W 4/027 |

FOREIGN PATENT DOCUMENTS

| | | | | |
|---|---|---|---|---|
| WO | WO-2015085071 | A1 * | 6/2015 | B63H 1/36 |

* cited by examiner

*Primary Examiner* — S. Joseph Morano
*Assistant Examiner* — Jovon E Hayes

(57) ABSTRACT

A craft comprises a torque reaction engine, a beam, and a fin secured to the beam. The torque reaction engine causes the beam to oscillate. The fin, secured to the beam, translates through a surrounding thrust fluid as a result of oscillation of the beam. Translation of the fin through the surrounding thrust fluid produces thrust and/or lift on the fin, propelling the beam and torque reaction engine. The craft may further comprise a harness and be a diver propulsion vehicle.

17 Claims, 22 Drawing Sheets

FIN-BASED DIVER PROPULSION VEHICLE

CROSS-REFERENCE

This application is a non-provisional of, claims the benefit of, and incorporates by reference United States provisional patent application No. 62/492,144, filed Apr. 29, 2017, 62/507,275, filed May 17, 2017, 62/618,080, filed Jan. 17, 2018, and 62/621,620 filed Jan. 25, 2018.

BACKGROUND

Diver propulsion vehicles (DPVs) generally comprise a battery, a motor, a driveshaft, a driveshaft seal or other technologies to prevent water from leaking up the driveshaft into the motor, a propeller, a propeller guard, a handle, motor controls, and a hull in which or to which the other components are mounted.

Conventional DPVs have efficiency issues of propeller-driven craft. For example, a motor-propeller efficiency curve for watercraft is roughly shaped like an inverted parabola, with the high point at a target speed. When the watercraft deviates from the target speed and goes "too fast" or "too slow", efficiency drops off in a non-linear manner.

DPVs are used in contexts that may include low visibility, currents, expected and unexpected obstructions, and the like, which creates an imperative toward safety in design of DPVs. In addition, foreign objects such as fingers, dive equipment, rocks, flotsam and jetsam, fish and the like may intersect with the propeller of a DPV in an unpredictable and hazardous manner. For example, fingers may be severely injured by a propeller, air tubes may be cut, and/or the function of the propeller and operation of the DPV may be impaired by intersection of a foreign object with the propeller. A propeller guard may be added to or increased in size around the propeller to make the DPV safer; however the larger the propeller guard is and the more safely the propeller is encased, the less efficient the DPV becomes. Similarly, an impeller may be used instead of a propeller, but impellers are less efficient than propellers.

More efficient DPVs have larger propellers with less propeller shielding, which makes such DPVs less safe.

Conventional propeller-driven DPVs also may produce noise, due to operation of the propeller and motor. Such noise may change the behavior of fish, may be unpleasant to the operator of the DPV, may be heard, and may otherwise be undesirable. Advanced propeller and motor design may reduce such noise, though at significant expense.

SUMMARY

U.S. patent application Ser. No. 15/101,901 discloses a torque reaction engine (TRE), use of which in a watercraft achieves fish-like motion. The resulting craft swims like a fish, marine mammal, or in an alternating spiral without the myriad parts that plague other mechanical craft that attempt to swim like a fish or marine mammal.

Certain of the inventions disclosed herein comprise devices, systems, and apparatus to accelerate thrust fluid and to produce thrust and/or lift in a DPV through use of a TRE.

DETAILED DESCRIPTION

Figure 1:
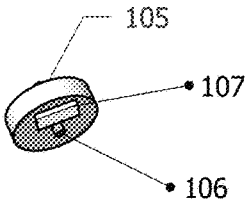
FIG. 1 illustrates an example of a motor that may be used in a fin-based diver propulsion vehicle.

The figures and text therein illustrate and discuss examples of a diver propulsion vehicle (DPV) that accelerates thrust fluid and achieves thrust through use of a torque reaction engine (TRE).

It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

As used herein, "releasable," "connect," "connected," "connectable," "disconnect," "disconnected," and "disconnectable" refers to two or more structures which may be connected or disconnected, generally without the use of tools (examples of tools including screwdrivers, pliers, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached.

As used herein, "thrust fluid" comprises a gas, a liquid, a plasma or other fluid media comprising mass, wherein the media may be accelerated by a moving fin, propeller, or the like or wherein the fin or propeller may be moved by a motor or wherein the thrust fluid is of a stream of thrust fluid and the stream of thrust fluid moves the fin or propeller. Energy is transferred between the thrust fluid and the fin or propeller, either by the moving thrust fluid moving the fin or propeller or by the moving fin or propeller moving the thrust fluid.

As discussed herein, each TRE comprises a drive shaft of an engine, wherein the drive shaft is secured to a portion of a hull and/or beam of a craft, an inertial mass located around or within the drive shaft, wherein the inertial mass may rotate around or within the drive shaft and wherein a bearing or set of bearings may be located between the inertial mass and the drive shaft. Inertial mass may comprise, for example, lead, a pack of batteries, a lead-acid paste battery, a lead-acid paste battery with a toroidal shape, iron, an electro magnet, and the like.

The engine may be located between and/or may comprise one or more of the inertial mass and the drive shaft. The engine causes the inertial mass to change its acceleration vector relative to the drive shaft, such as by slowing down, speeding up, or reversing rotation of the inertial mass relative to the drive shaft. Torque reaction produced on the drive shaft by change in acceleration vector of the inertial mass by the engine causes the drive shaft and portion of the beam secured to such drive shaft to experience a torque reaction. If the beam is not held in place by an external object, the torque reaction on the drive shaft will cause the beam to rotate, opposite a change in acceleration vector of the inertial mass.

The TRE may be controlled by a controller to cyclically reverse an acceleration vector of the inertial mass. Torque reaction on the drive shaft by cyclic reversal of the acceleration vector of the inertial mass causes the drive shaft to cyclically rotate in a first direction (such as clockwise), then in a second direction (such as counterclockwise), then in the first direction, etc., opposite the acceleration vector of the inertial mass, so long as power is available and the controller comprises suitable instructions. Cyclic rotation of the drive shaft in the first and second directions may be referred to herein as, "cyclic oscillation".

During a first phase of operation of a TRE, the motor may apply power to accelerate the inertial mass. During a second phase of operation of the TRE, the motor may apply a brake to decelerate the inertial mass. The motor may be an electric motor or an internal combustion motor. The brake may generate power, such as when the motor is an electric motor and the brake is an electronic or magnetic brake or such as when the motor is an internal combustion engine and the brake compresses a gas or accelerates a fly wheel.

As used herein, the drive shaft may also be referred to as a "stator" and the inertial mass may be referred to as a "rotor". These identifiers are somewhat arbitrary, except inasmuch as they distinguish a first component and a second component, wherein one of the two components carries an inertial mass, and wherein the first and second components may rotate relative to one another around a common axis.

In the example discussed herein, the drive shaft is secured to a craft. The drive shaft may be secured to a hull of the craft, a pressure and/or isolation capsule surrounding the TRE, a beam, or the like ("beam"). At least a fin is secured to the beam. Cyclic oscillation of the drive shaft is communicated to the fin by the beam, resulting in translation of the fin, back and forth, through a surrounding thrust fluid. Translation of the fin through the surrounding thrust fluid accelerates thrust fluid, resulting in thrust and/or lift on the fin, which may propel the craft.

FIG. 1 illustrates an example of motor housing 105 that may be used in a fin-based DPV. The motor housing comprises drive shaft 106. The motor housing 105 may surround or be within drive shaft 106, as-in the case of an "outrunner" style electric motor. Permanent and/or electronic magnets in motor housing and/or secured to drive shaft interact to change the relative acceleration vector of motor housing 105 and drive shaft 106. In the examples discussed herein, motor housing 105 is in the category of a rotor. Secured to motor housing 105 is controller 107. Controller 107 may be used to control operation of the TRE in the DPV.

Figure 2:
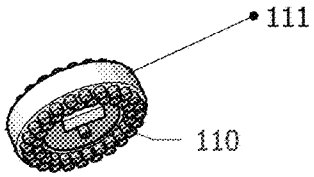
FIG. 2 illustrates an example of a battery pack secured to a stator of the motor of FIG. 1.

FIG. 2 illustrates an example of battery pack 110 secured to motor housing 105 of FIG. 1. In the examples discussed herein, battery pack 110 and motor housing 105 are inertial mass. Also illustrated in FIG. 2 is battery frame 111; battery frame 111 may be used to secure battery pack 110 to motor housing 105.

Figure 3:
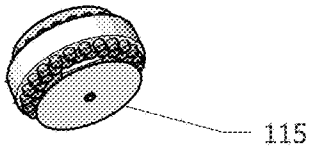
FIG. 3 illustrates an example of a mounting plate of an isolation capsule secured to a rotor of the motor of FIG. 1.
Figure 20:
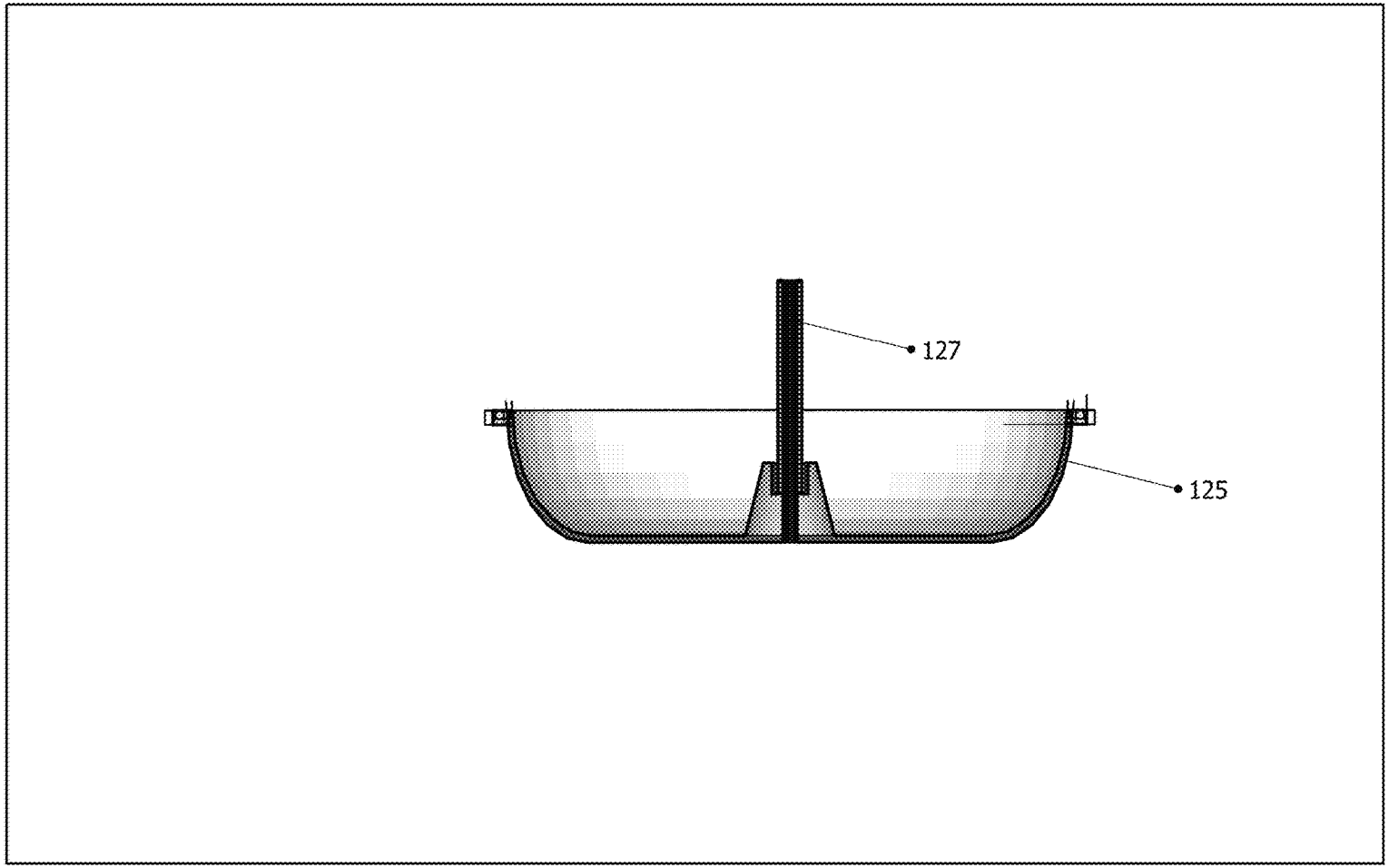
FIG. 20 illustrates an example of the second half of the isolation capsule in isolation.
Figure 21:
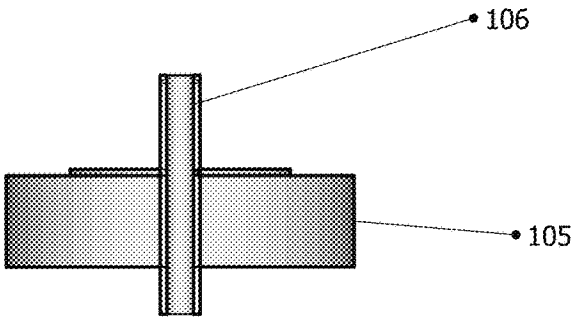
FIG. 21 illustrates an example of the motor that may be used in the fin-based diver propulsion vehicle

FIG. 3 illustrates an example of mounting plate 115 of an isolation capsule. Mounting plate 115 may be secured to drive shaft 110. Mounting plate 115 may extend through a hollow center of drive shaft 106, and be hollow itself, like a straw. Mounting plate 115 may be integrated into an isolation capsule. An example of a second half of an isolation capsule 125 with a straw 127 that extends through a hollow center of drive shaft 106 is illustrated in FIG. 20.

Figure 4:
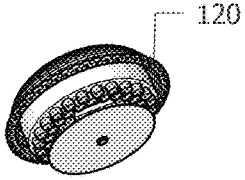
FIG. 4 illustrates an example of a first half of an isolation capsule secured to the rotor of the motor of FIG. 1.

FIG. 4 illustrates an example of a first half of an isolation capsule 120 secured to drive shaft 110 and/or mounting plate 115.

Figure 5:
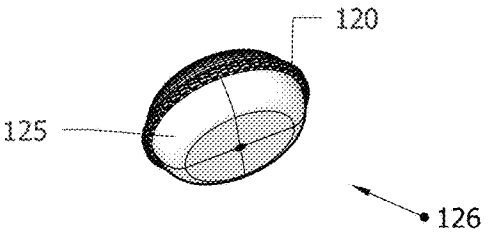
FIG. 5 illustrates an example of a second half of the isolation capsule secured to the rotor of the motor of FIG. 1.

FIG. 5 illustrates an example of a second half of isolation capsule 125. The first and second halves together are referred to herein as isolation capsule 126.

Figure 6:
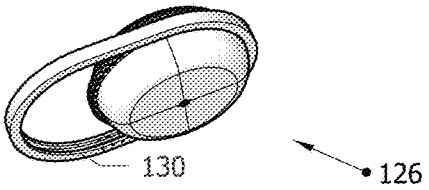
FIG. 6 illustrates an example of a dive ring of the fin-based diver propulsion vehicle.

FIG. 6 illustrates an example of dive ring 130 of a fin-based DPV. Dive ring 130 allows isolation capsule 126 to travel fore-aft within dive ring 130. Relocation of isolation capsule 126 within dive ring 130 changes the center of gravity of the DPV. In this example, change in center of gravity of DPV changes a pitch of the DPV. For example, when isolation capsule 126 is in a fore position along dive ring 126, the pitch of DPV may be downward, so that when power is applied by the TRE, the DPV swims downward. For example, when isolation capsule 126 is in an aft position along dive ring 130, the pitch of DPV may be upward, so that when power is applied by the TRE, the DPV swims upward. A bolt or ratchet-type mechanism, such as a pawl, solenoid, ratchet or the like may hold isolation capsule 126 in a position along dive ring 130 and prevents isolation capsule from rotating separately from dive ring 130. When the ratchet-type mechanism is disengaged or released and power is applied to the TRE, isolation capsule 126 may rotate within and separately from dive ring 130. For example, dive ring 130 may include teeth on the top of dive ring 130 and cut-outs (such as cut-outs 135 in FIG. 7) around a perimeter of isolation capsule 126 may engage with such teeth. Power may be applied to TRE, causing a torque reaction that causes isolation capsule 126 to rotate and travel fore or aft along dive ring 130. When isolation capsule 126 reaches a desired location, the ratchet-type mechanism may deploy or engage, to hold isolation capsule 126 at such location. Deployment of the ratchet-type mechanism may be through, for example, passage 140, illustrated in FIG. 7.

Shifting the location of isolation capsule 126 within dive ring 130 changes the center of gravity of the DPV, allowing the DPV to dive or surface (assuming a vertical orientation of the motor, relative to a gravitational field).

Figure 7:
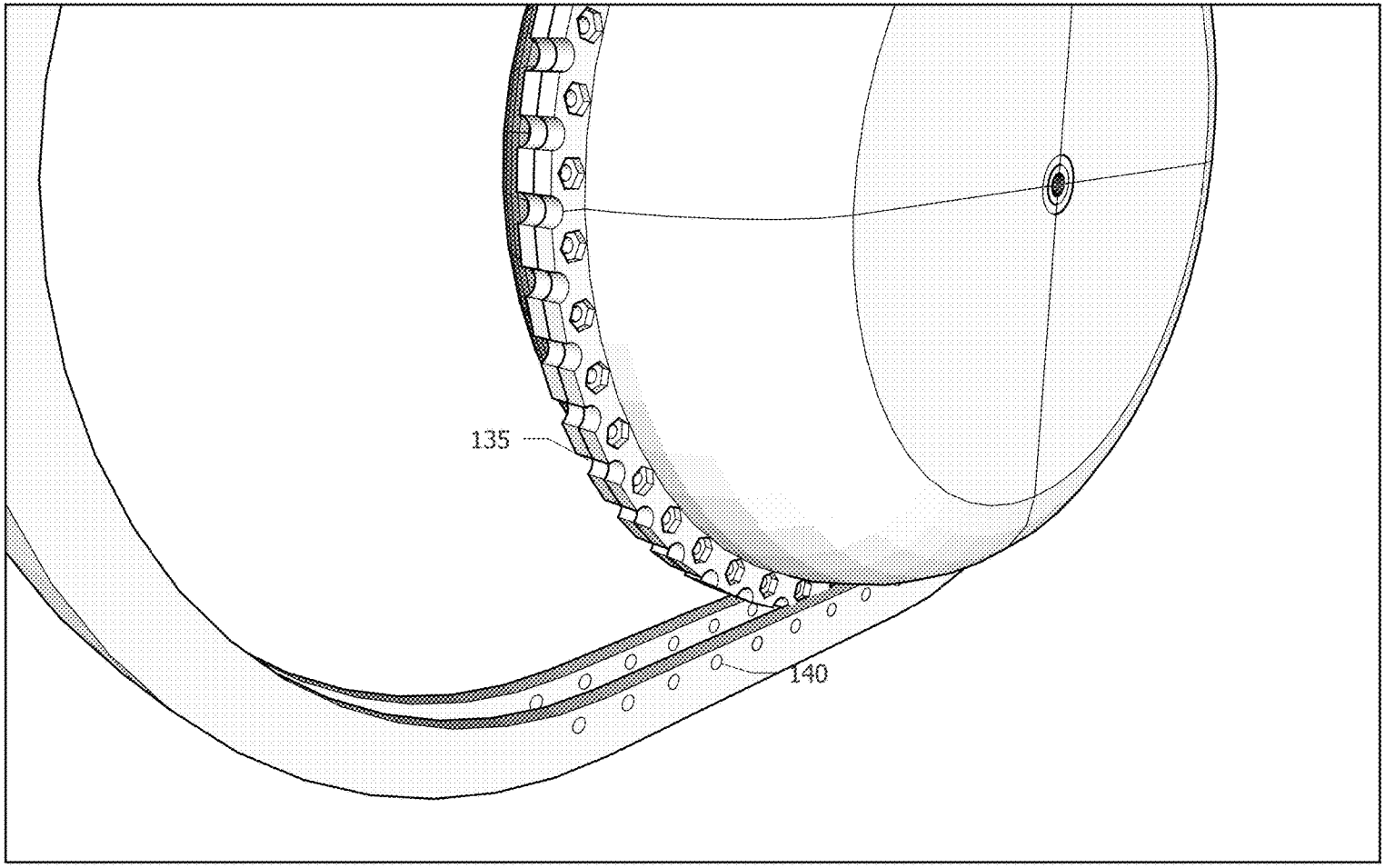
FIG. 7 illustrates an example of a detail view of the dive ring and isolation capsule of FIG. 6.

For example, FIG. 7 illustrates an example of a detail view of dive ring 130, with negative teeth, recepticles, or cut-outs 135 that may be engaged by a rod, pawl, solenoid, or other retractable ratchet-type mechanism that may engage between dive ring 130 and isolation capsule 126, such as through passage 140.

When isolation capsule 126 has obtained a desired location relative to dive ring 130, the ratchet-type mechanism may be deployed to hold isolation capsule 126 in the desired position. Thus, a controller of the TRE, such as controller 111, may be coupled with a controller of the ratchet-type mechanism, to engage the TRE and ratchet-type mechanism synchronously to cause the DPV to change its pitch.

Figure 8:
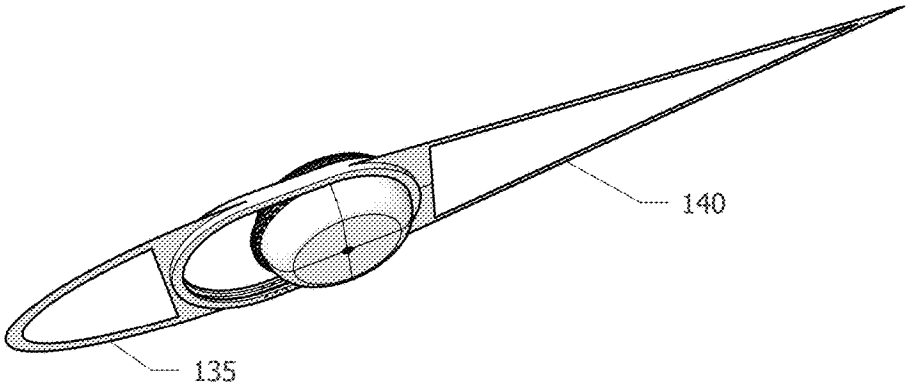
FIG. 8 illustrates an example of a nose plate and a tail plate of the fin-based diver propulsion vehicle.

FIG. 8 illustrates an example of nose plate 135 and tail plate 140 of the fin-based DPV. Nose plate 135 and tail plate 140 may be made of a flexible material, such as carbon fiber, fiberglass, aramid and resin, plastics, flexible metal, and the like. This material may be flexible along a first dimension, such as to allow the ends of nose plate 135 and tail plate 140 to bend toward each other, and substantially rigid along a second dimension, such as to allow nose plate 135 and tail plate 140 to cyclically oscillate, driven by the TRE, and translate a fluke through a surrounding thrust fluid.

Figure 9:
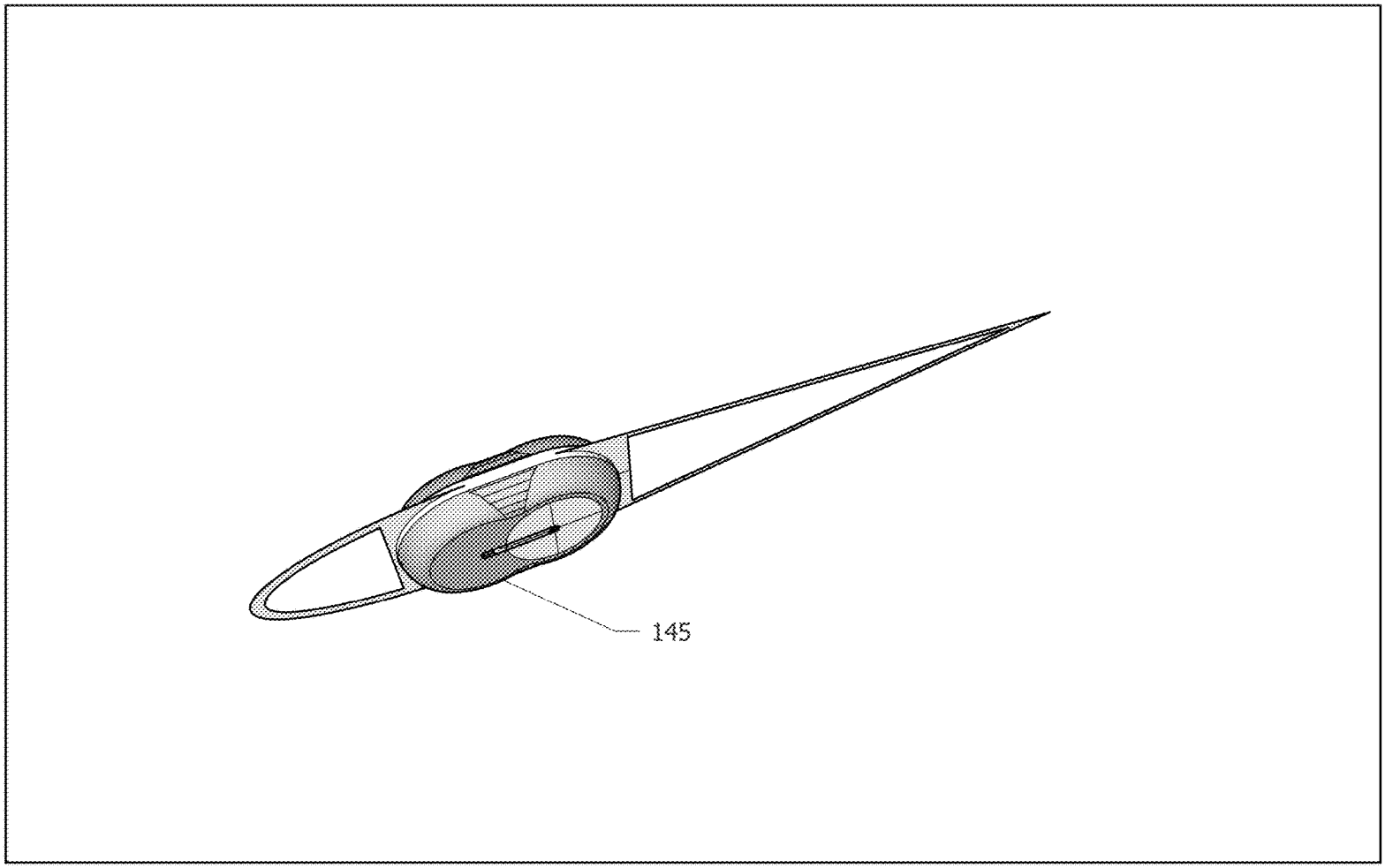
FIG. 9 illustrates an example of an isolation capsule shell of the fin-based diver propulsion vehicle.

FIG. 9 illustrates an example of shell 145 that may protect isolation capsule 126 and allow isolation capsule 126 to move fore and aft within dive ring 130. Shell 145 may be flooded. Shell 145 may contain displacement. Displacement within shell 145 may be provided by airbag(s), syntactic foam pellets, wedges, or the like. Displacement within shell 145 may be free to relocate within shell 145, such as through channels at the top and bottom, as isolation capsule 126 relocates along dive ring 130. The air and/or number of pellets may be varied to change the overall displacement of the craft and to shift the center of displacement fore and aft. As with other of the components discussed herein, shell 145 is optional.

Figure 10:
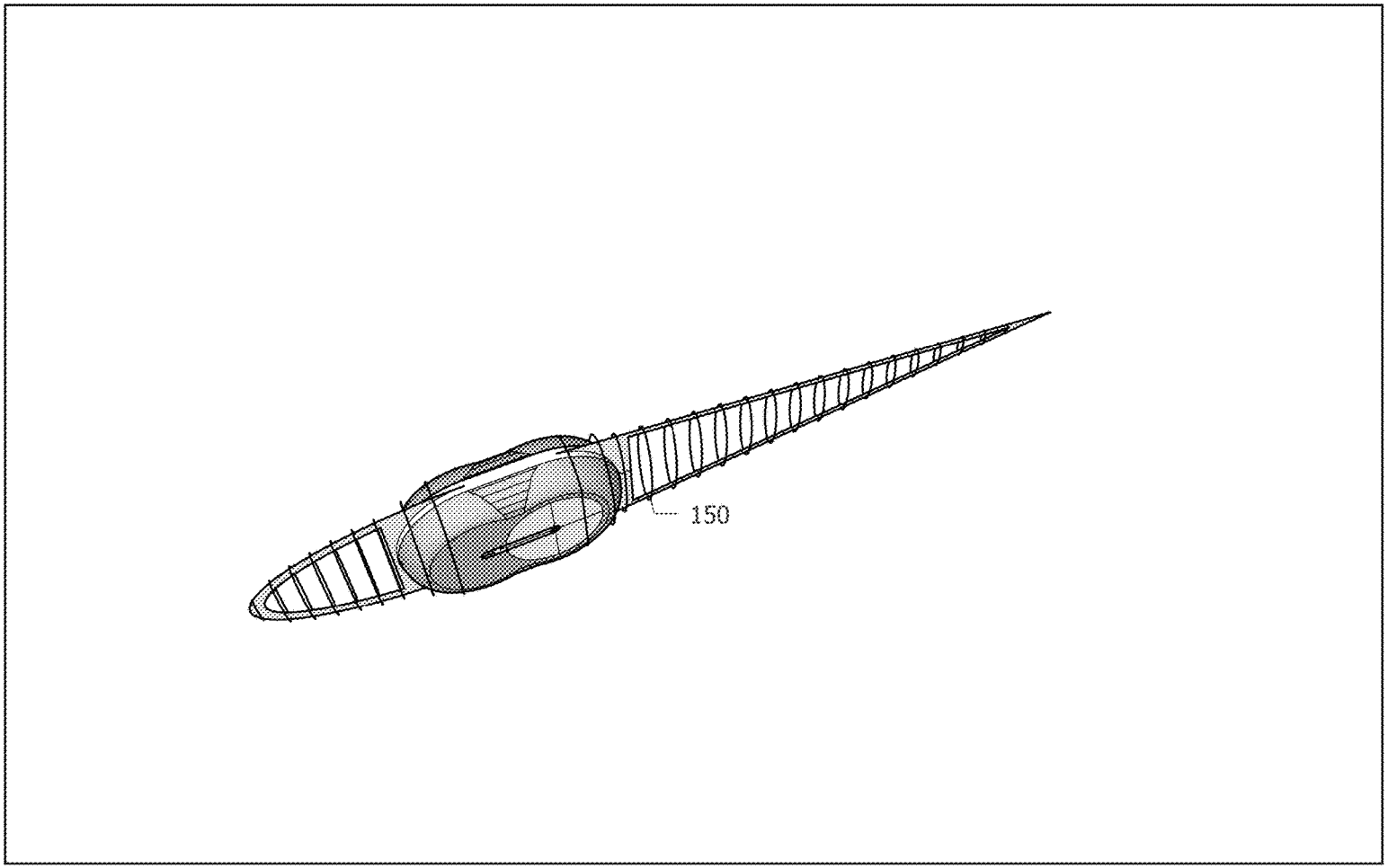
FIG. 10 illustrates a schematic view an example of displacement secured to the fin-based diver propulsion vehicle.

FIG. 10 illustrates a schematic view an example of displacement secured to the fin-based DPV and/or of ribs, straps, or fabric that may hold displacement to the fin-based DPV, hereinafter referred to as displacement 150. Displacement 150 may comprise syntactic foam wedges, syntactic foam pellets, airbags, bags of a liquid that is less dense than water. Within displacement 150, tendons (not illustrated), may anchor displacement modules to a bottom edge of nose plate 135 and tail plate 140 or top plate(s) (not illustrated) may hold displacement down within the area of displacement 150. As noted, displacement 150 illustrated in FIG. 10 may indicate the surface of a fabric "suit" worn by the DPV. The fabric suit may hold displacement to the fin-based DPV and/or may act as a fairing, to smooth water flow over the DPV.

Figure 11:
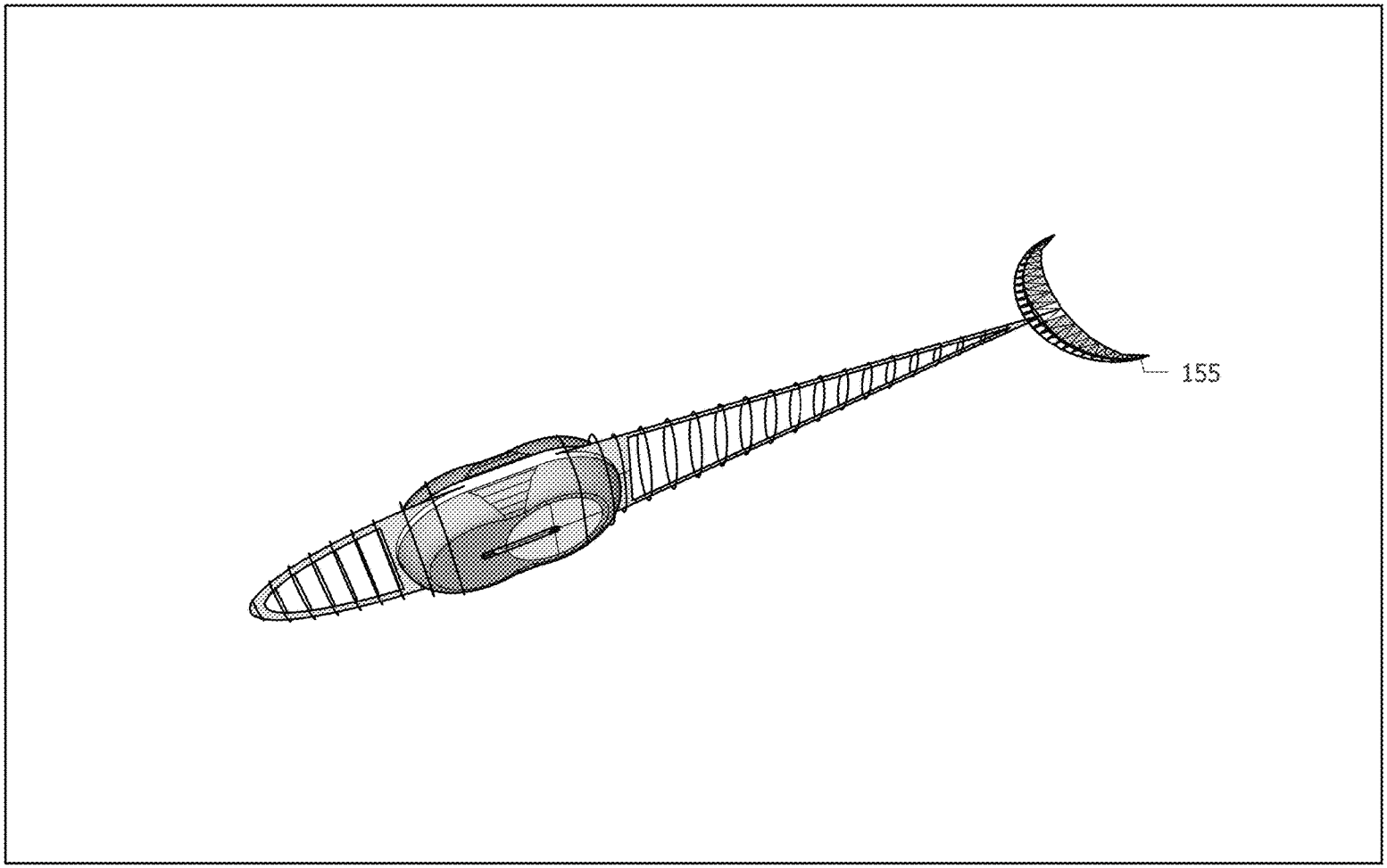
FIG. 11 illustrates an example of a fluke secured to the fin-based diver propulsion vehicle.

FIG. 11 illustrates an example of fluke 155 secured to the fin-based DPV. In this example, fluke 155 is secured to tail plate 140; in other embodiments, one or more fins may be secured elsewhere on the DPV, such as to nose plate 135, along a bottom or top edge of the DPV, and the like. Fluke may also be referred to herein as a "fin". Fluke 155 may be secured to tail plate 140 by a flexible tendon and/or by a bearing that allows fluke 155 to rotate relative to tail plate 140.

Figure 12:
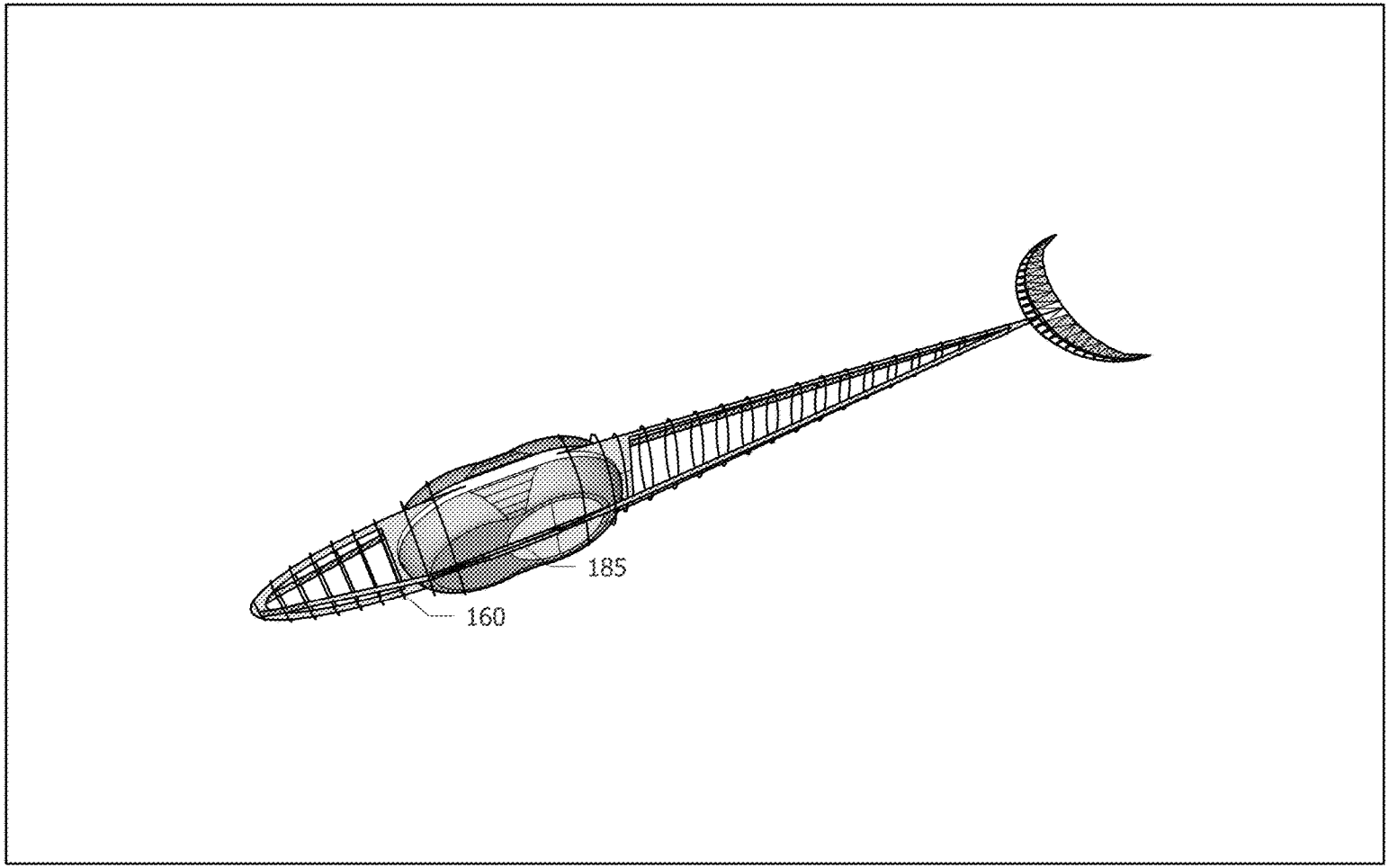
FIG. 12 illustrates an example of steering straps of the fin-based diver propulsion vehicle.

FIG. 12 illustrates an example of cords or steering straps 160 and expansion-contraction joint 185 of the fin-based DPV. Steering straps 160 may shorten in length on a first side of the DPV and increase in length on a second side of the DPV, through use any of a set of techniques or devices, such as via expansion-contraction joint 185, thereby pulling the ends of nose plate 135 and tail plate 140 toward one another. When pulled toward one another, a top or bottom plane view of DPV forms a semicircle or semicircular shape. When the plane view of DPV is semicircular and when power is applied to the TRE and fluke 155 generates thrust and/or lift, DPV turns.

Techniques or devices to shorten a length of steering straps 160 on a first side of the DPV and increase a length of steering straps 160 on a second side of the DPV include, without limitation, the following: Steering straps 160 may pass through a center of TRE, such as through a hollow drive shaft 110 and/or hollow central straw of isolation capsule 126 that may pass through hollow drive shaft 110. Steering straps 160 may comprise two sets of cords or straps. A first set of cords or straps may form a circle from the fluke end of tail plate 140 on a port side of the DPV, through hollow drive shaft 110 and back to the fluke end of tail plate 140 on a starboard side of the DPV. A second set of cords or straps may form a circle from the nose end of nose plate 135 on a port side of the DPV, through hollow drive shaft 110 and back to the nose end of nose plate 135 on a starboard side of the DPV. The two sets of cords or straps may be pulled together through hollow drive shaft 110 to shorten a length of steering straps 160 on a first side of the DPV and increase a length of steering straps 160 on a second side of the DPV.

Figure 15:
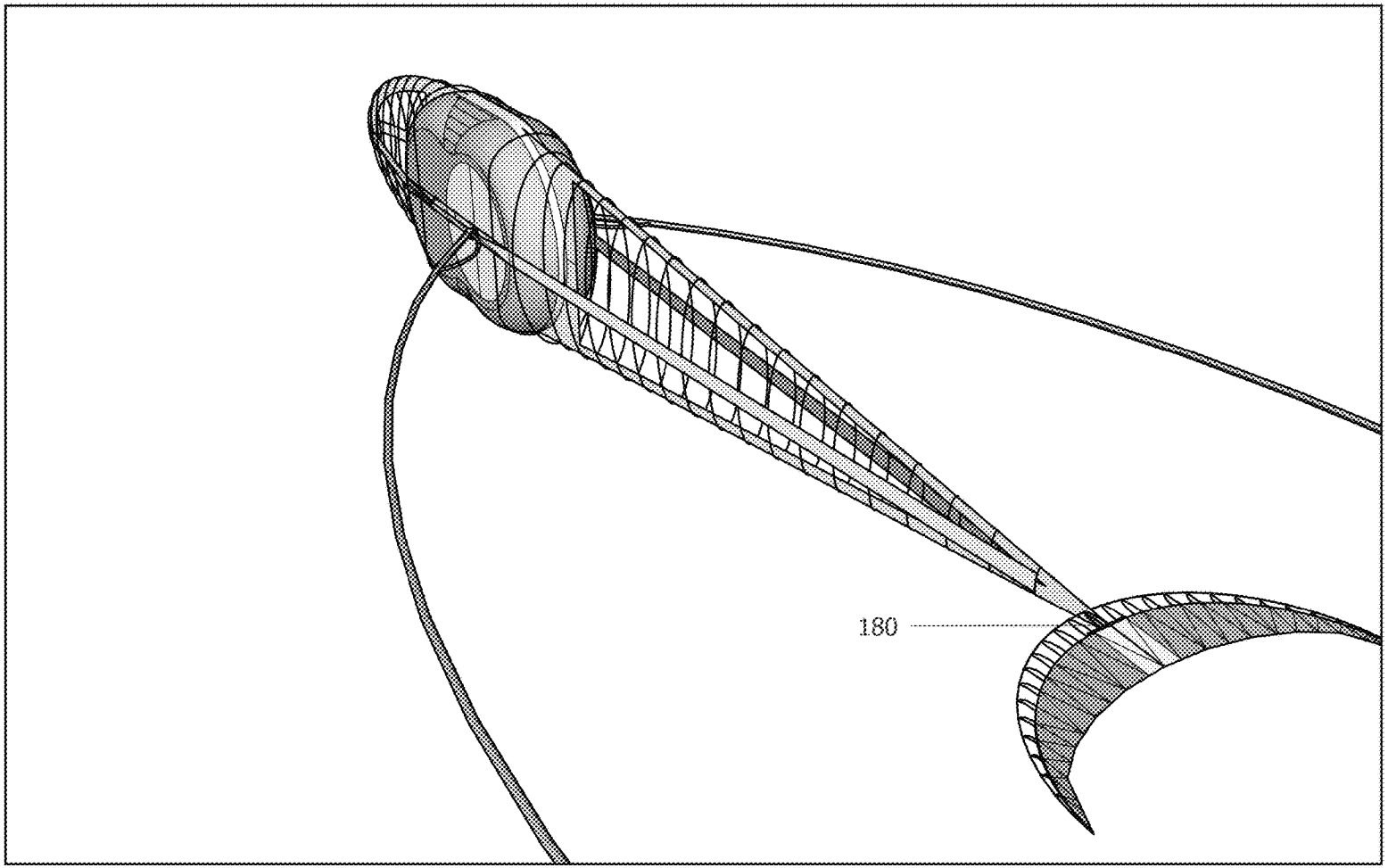
FIG. 15 illustrates an example of a spring loaded adjustable fluke bearing.

Techniques or devices to shorten a length of steering straps 160 on a first side of the DPV and increase a length of steering straps 160 on a second side of the DPV include, without limitation, the following: Steering straps 160 may be secured at the fluke end of tail plate 140 and the nose end of nose plate 135. Steering straps 160 may comprise expansion-contraction joint 185 on each side of DPV. The expansion-contraction joint 185 may receive a power input from a power transfer media and may expand or contract in response to the power input. For example, the power transfer media may comprise one of a fluid, a wire, and a solid bar. For example, the power transfer media may be hydraulic, in which case expansion-contraction joint 185 may comprise pistons within expansion-contraction joint 185, Such piston may move in response to input power to shorten or lengthen steering straps 160 on the sides of the DPV. For example, the power transfer media may be wires or inelastic cords routed through a pulley system in expansion-contraction joint 185. Input power to power transfer media may come, for example, from a steering power source. The steering power source may comprise one of a human, a hydraulic engine, an electric engine, a solenoid, a linear engine. An example of a steering power source is illustrated in FIG. 15 at steering input 175. The steering power source may be located on or in the fin-based DPV, such as on isolation capsule 126, on expansion-contraction joint 185.

Figure 13:
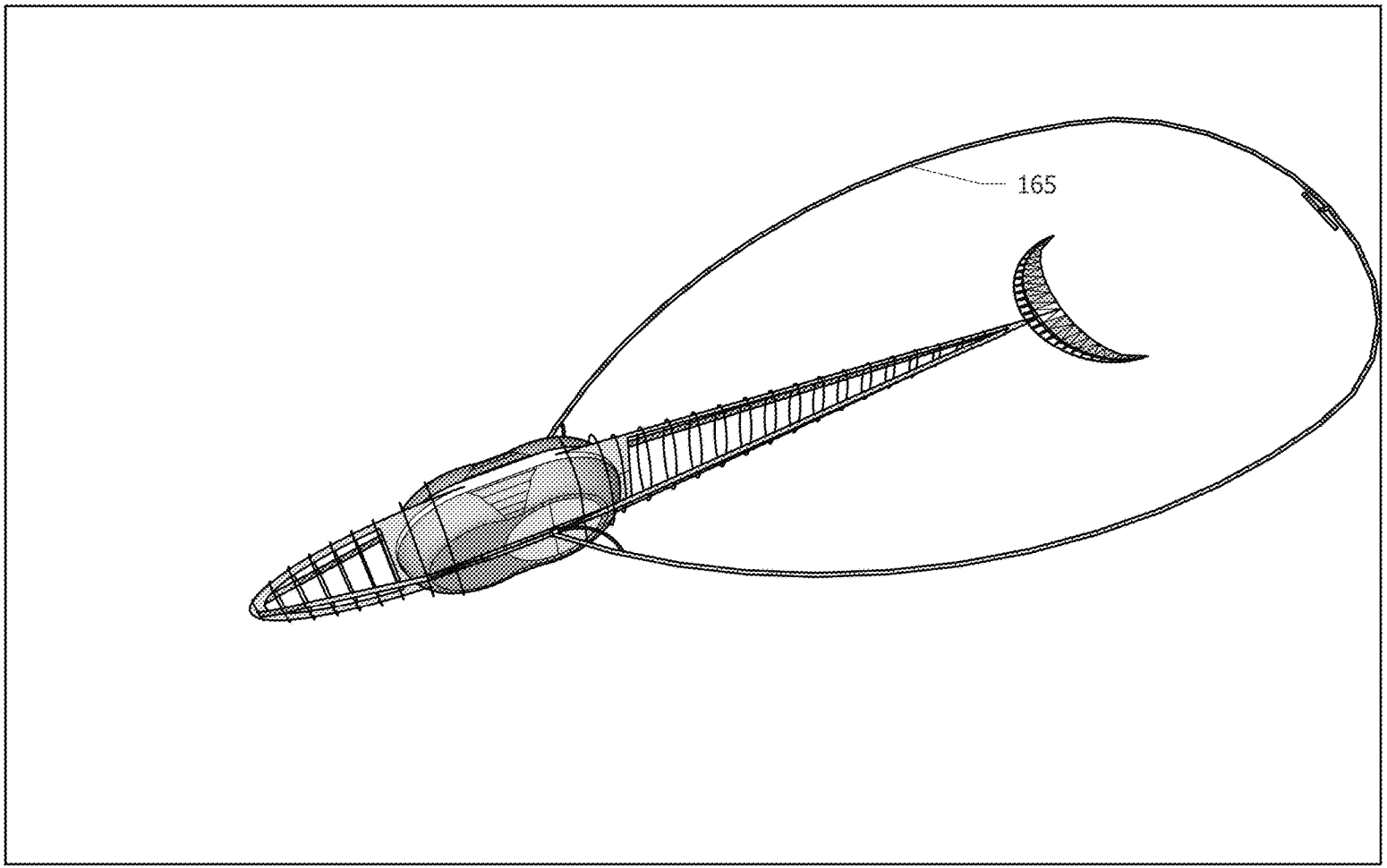
FIG. 13 illustrates a first example of a harness of the fin-based diver propulsion vehicle.

FIG. 13 illustrates a first example of harness 165 of a fin-based DPV. Harness 165 may be held by a human, a barge, or another payload or object to be pulled by the DPV. Harness 165 may comprise toggles, buttons, or similar to provide input signal to controller 111, such as input to instruct controller 111 to vary a frequency and/or power of the TRE as it goes through phases of operation of the TRE.

Figure 14:
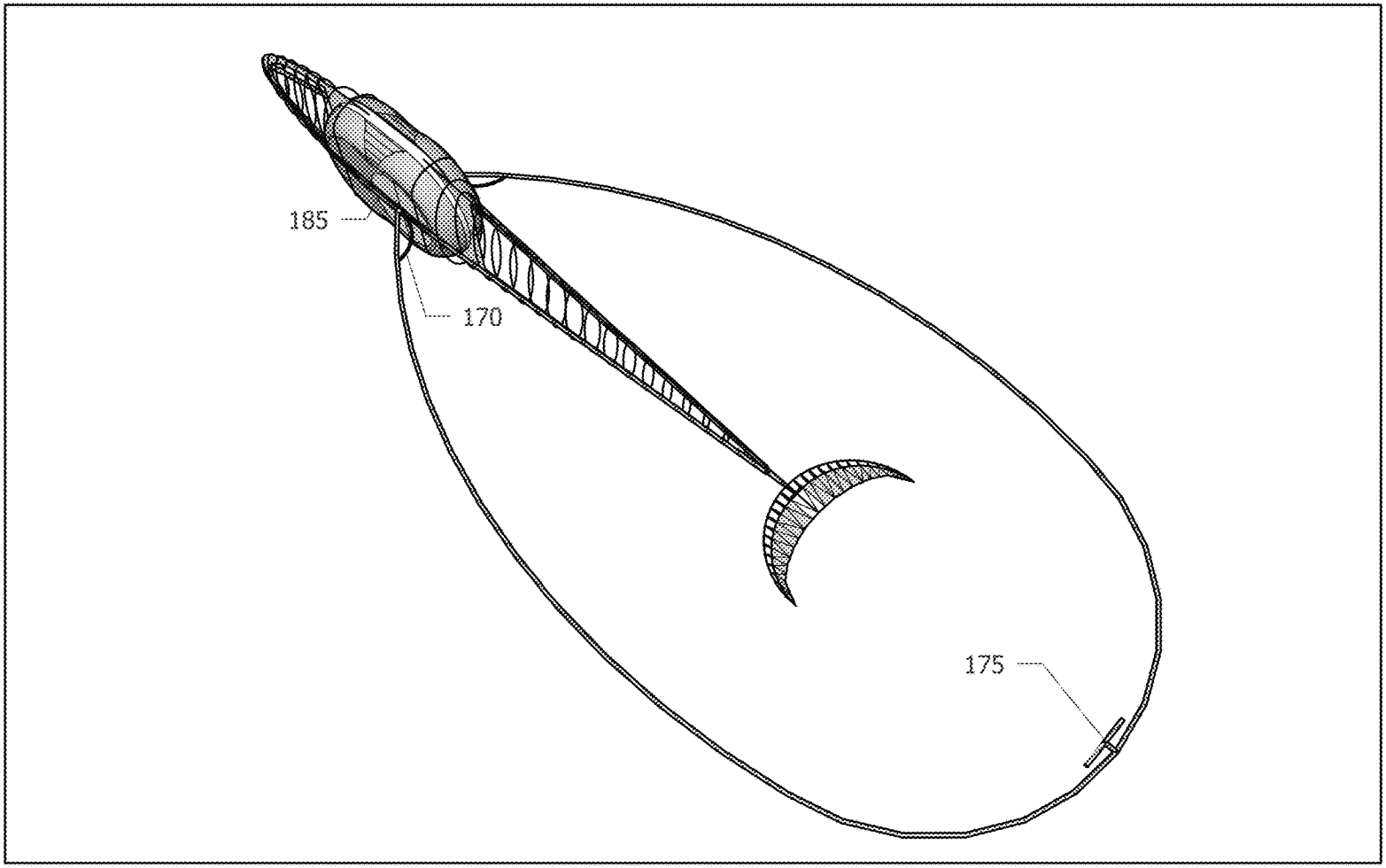
FIG. 14 illustrates an example of containment or steering power lines for a power transfer media.

FIG. 14 illustrates an example of containment for a power transfer media, in this example, hydraulic lines or wire guides within harness 165 leading from steering input 175 to wire guide or hydraulic lines 170, to expansion-contraction joint 185. Steering input 175 may allow a person or other steering power source to squeeze steering input 175 on the port side to cause steering straps 160 to contract on the port side and expand on the starboard side, thereby bending the DPV into a semicircular shape and resulting in DPV steering to port. Instead of and/or in addition to a power transfer media, harness 165 may contain or convey a signal transfer media, to convey signals to TRE, to controller 111, to a controller of a pawl, to a controller of components that may provide power to expansion-contraction joint 185, or the like.

FIG. 15 illustrates an example of spring loaded adjustable fluke bearing 180. Fluke bearing 180 may allow fluke 155 to have greater or lesser flexure or to articulate more or less, relative to the DPV, such as at different speeds. Fluke bearing 180 may comprise a flexible material, such as carbon fiber, fiberglass, and/or aramids in resin, plastics, flexible metal, and the like. Alternatively, fluke bearing 180 may comprise a bearing that allows fluke 155 to rotate around fluke bearing 180, with a spring, stop, detent or other such component to impede rotation of fluke 155 around fluke bearing 180, allowing fluke 155 to achieve an angle of attack relative to a surrounding thrust fluid, such that fluke 155 produces thrust and/or lift.

Figure 16:
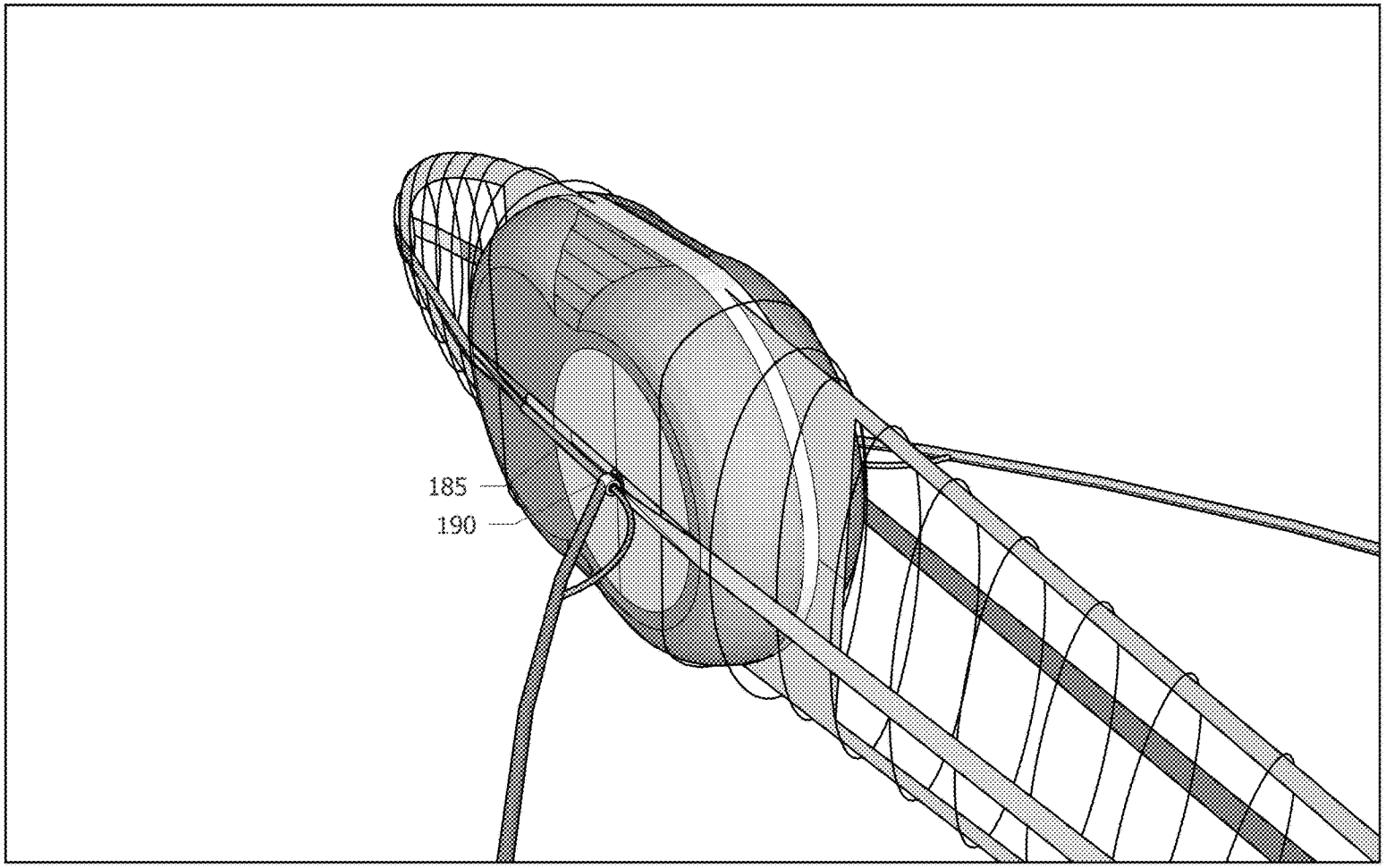
FIG. 16 illustrates an example of an expansion-contraction joint and a harness motor mount

FIG. 16 illustrates an example of expansion-contraction joint 185 and harness motor mount 190. These components are further illustrated and discussed in relation to FIG. 17.

Figure 17:
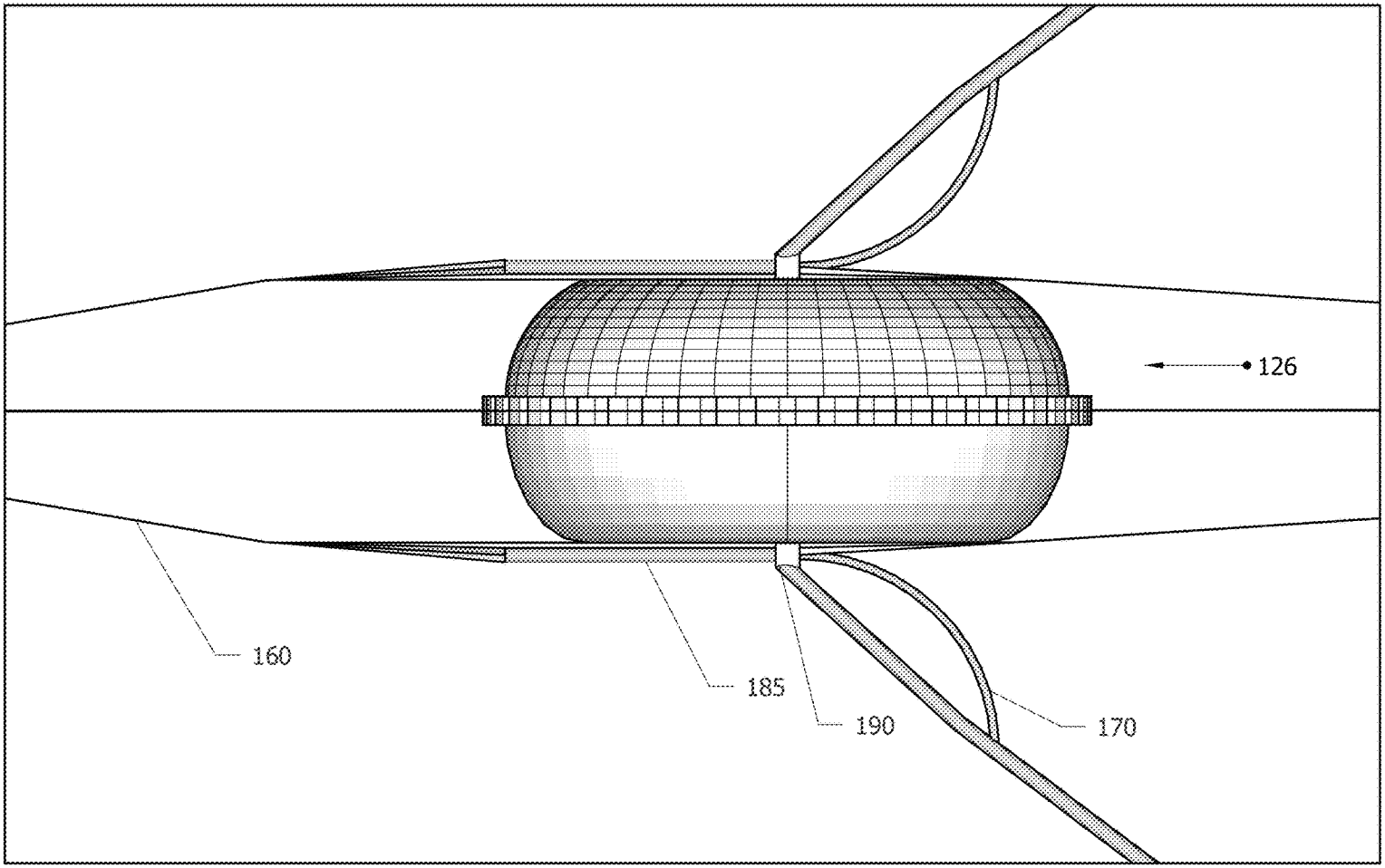
FIG. 17 illustrates an example of a plan view of a TRE in a fin-based DPV.

FIG. 17 illustrates an example of a plan view of an isolation capsule 126 of a TRE in a fin-based DPV. Shown in FIG. 17 are expansion-contraction joint 185, harness-motor mount 190, steering straps 160, and hydraulic lines 170. Harness-motor mount 190 may pass through isolation capsule 126 or may be secured to a rod, tube, or straw that passes through isolation capsule 126, such as through a hollow drive shaft 110 (examples of such an isolation capsule and hollow drive shaft are illustrated and discussed in relation to FIG. 18-21). Harness 165 may be secured to harness-motor mount 190. Expansion-contraction joint 185 may pass through harness-motor mount 190, allowing harness-motor mount 190 and isolation capsule 126 to reposition along dive ring 130, with harness-motor mount 190 passing around expansion-contraction joint 185.

Figure 18:
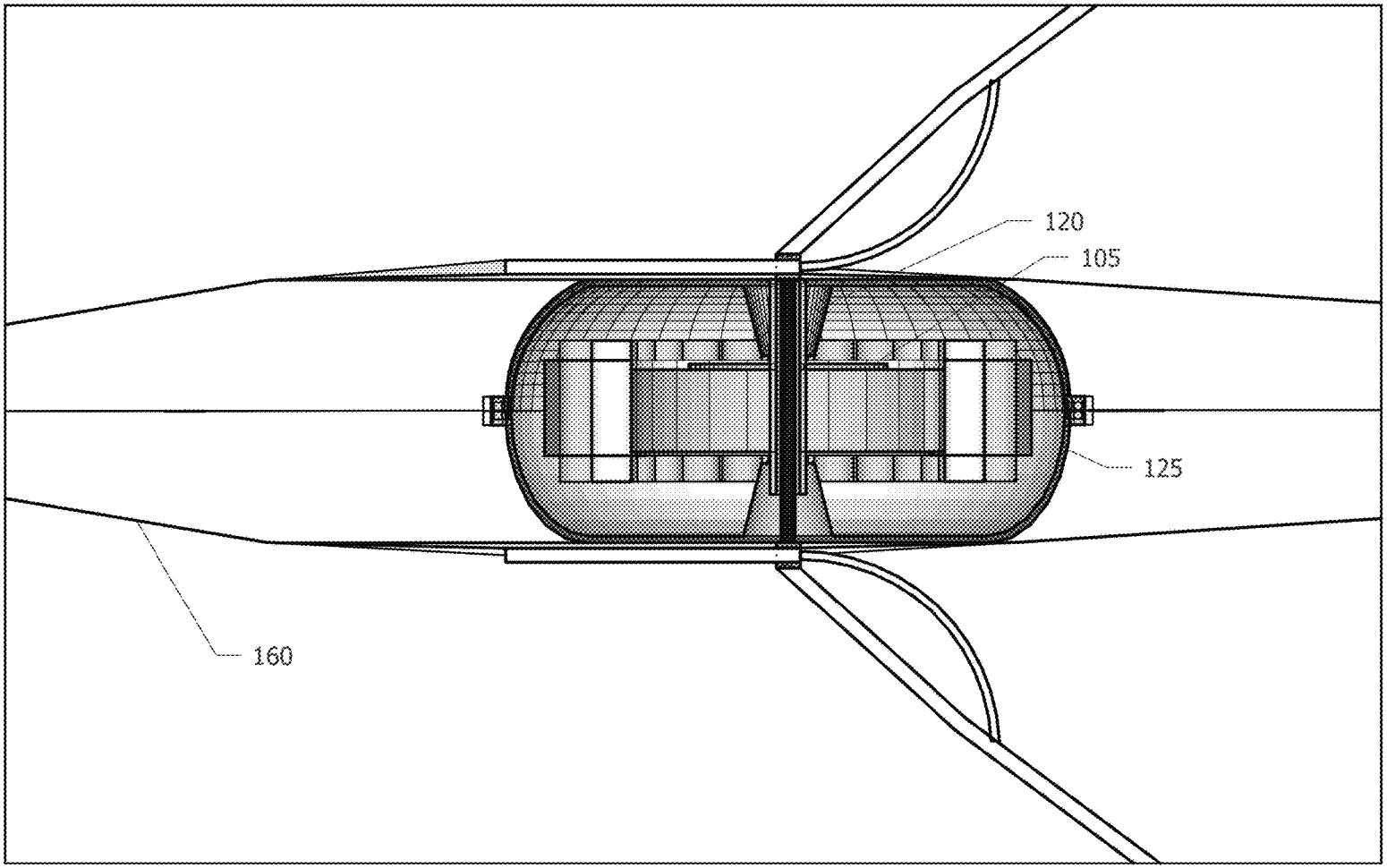
FIG. 18 illustrates the plan view of the torque reaction engine in the fin-based diver propulsion vehicle of FIG. 18, with a section cut through a midline of the torque reaction engine.
Figure 19:
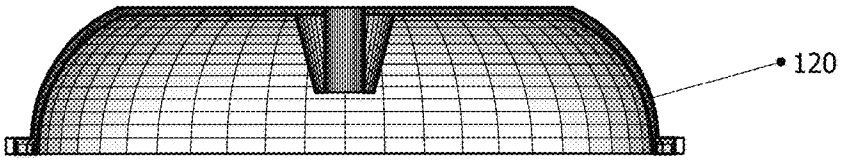
FIG. 19 illustrates an example of the first half of the isolation capsule in isolation.

FIG. 18 illustrates the plan view of the TRE in the fin-based DPV of FIG. 18, with a section cut through a midline of the TRE. For the sake of clarity, FIG. 19 illustrates an example of the first half of the isolation capsule 120 in isolation. For the sake of clarity, FIG. 20 illustrates an example of the second half of the isolation capsule 125 in isolation. In this Figure, a central straw 127 of the second half of the isolation capsule 125 is distinguishable; the central straw may pass through a hollow center of drive shaft 110. The central straw 127 may allow items to pass through a center of the TRE, such as steering straps, a rod, a hollow rod, and the like. The hollow center of drive shaft 110 may be larger than as illustrated.

Figure 22:
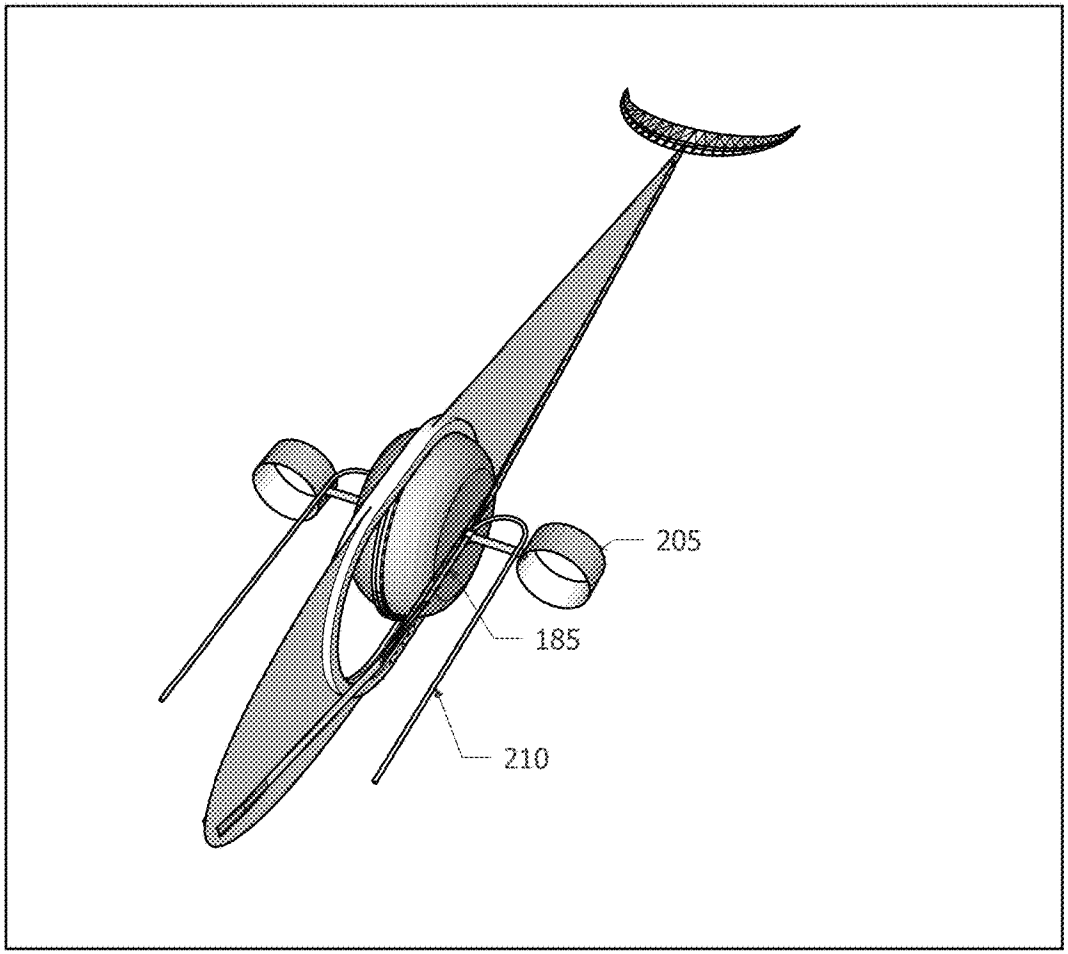
FIG. 22 illustrates a second example of a harness of a fin-based diver propulsion vehicle.

FIG. 22 illustrates a second example of a harness of a fin-based DPV. In this second example, leg, foot, or ankle straps 205 may be secured DPV to a human's leg, foot, or ankle. An example of containment for a power transfer media is illustrated in FIG. 22 at hydraulic line 210, that is secured to expansion-contraction joint 185.

Following are non-limiting examples:

Example 1

A robotic fish comprising a torque reaction engine within a capsule within a dive ring.

Example 2

The robotic fish according to Example 1, wherein the capsule relocates within the dive ring to cause the robotic fish to dive and surface.

Example 3

The robotic fish according to Example 2, wherein the capsule is held in place within the dive ring by a pawl.

Example 4

The robotic fish according to Example 2, wherein the dive ring is secured to one or more of a nose plate and a tail plate.

Example 5

The robotic fish according to Example 4, wherein the nose and tail plates are flexible.

Example 6

The robotic fish according to Example 4, wherein one of the nose and tail plates are secured to a fin.

Example 7

The robotic fish according to Example 6, wherein a flexure of the fin is adjustable.

Example 8

The robotic fish according to Example 7, wherein ends of the nose and tail plates are secured by cords.

Example 9

The robotic fish according to Example 8, wherein the cords expand on a first side of the robotic fish and contract on a second side of the robotic fish.

Example 10

The robotic fish according to Example 9, wherein expansion and contraction of the cords bends at least one of the nose or the tail plate.

Example 11

The robotic fish according to Example 9, wherein the cords comprise an expansion-contraction joint.

Example 12

The robotic fish according to Example 11, wherein the expansion-contraction joint receives a power input and wherein the power input causes the cords to expand on a first side of the robotic fish and contract on a second side of the robotic fish.

Example 13

The robotic fish according to Example 12, wherein the expansion-contraction joint is secured to a power transfer media and wherein the power transfer media transfers the power input to the expansion-contraction joint from a steering power source.

Example 14

The robotic fish according to Example 13, wherein the power transfer media is one of a fluid, a wire, and a solid bar.

Example 15

The robotic fish according to Example 1, wherein the robotic fish further comprises a harness.

Example 16

The robotic fish according to Example 15, wherein the harness allows a human to hold the robotic fish.

Example 17

The robotic fish according to Example 16, wherein the harness allows the human to hold the robotic fish between a pair of legs of the human.

Example 18

The robotic fish according to Example 15, wherein the harness is held from behind.

Example 19

The robotic fish according to Example 15, wherein the harness comprises a power transfer media and wherein the power transfer media transfers a power input to an expansion-contraction joint from a steering power source.

Example 20

The robotic fish according to Example 19, wherein the steering power source is one of a human, a hydraulic engine, an electric engine, a solenoid, a linear engine.

Example 21

The robotic fish according to one or more of Example 1 to 19 or some other example herein, wherein the fish comprises displacement.

Example 22

The robotic fish according to one or more of Example 1 to 20 or some other example herein, wherein the displacement is secured to at least one of nose and tail plates.

Example 23

The robotic fish according to one or more of Example 1 to 21 or some other example herein, wherein a shell surrounds the isolation capsule.

Example 24

The robotic fish according to one or more of Example 1 to 22 or some other example herein, wherein the shell comprises shell displacement.

Example 25

The robotic fish according to one or more of Example 1 to 23 or some other example herein, wherein the shell displacement may be varied fore and aft.

Example 26

The robotic fish according to one or more of Example 1 to 24 or some other example herein, wherein the fin may be deployed from a nose to produce reverse thrust.

Example 27

An adjustable spring-loaded hinge securing a tail to a TRE, wherein a spring of the adjustable spring may be adjusted to change flexure of the tail, relative to the TRE.

Example 28

The adjustable spring-loaded hinge of Example 5, wherein the adjustment is made to make the tail more flexible at slower speeds and is to make it more stiff at higher speeds.

Example 29

The adjustable spring-loaded hinge of at least one of Example 5 to Example 6, wherein the adjustment is made to produce a steering force.

Example 30

An adjustable location of a securement between a tail and a hull, wherein the adjustable location may be adjusted to produce a steering force.

Example 31

A robotic fish comprising a torque reaction engine, a fore displacement relative to the torque reaction engine, and an aft displacement relative to the torque reaction engine, wherein a center of gravity of the robotic fish may be changed by changing a location of the torque reaction engine relative to the fore displacement and the aft displacement.

Example 32

The robotic fish according to Example 31, wherein the relative location is changed by relocating the torque reaction engine fore and aft or up and down within a dive ring.

Example 33

The robotic fish according to Example 32, wherein a pawl engages to lock the torque reaction engine in a location within the dive ring and disengages to allow the torque reaction engine to relocate within the dive ring.

Example 34

The robotic fish according to Example 32, wherein the dive ring comprises a track and wherein the track allows the torque reaction engine to relocate within the dive ring.

Example 35

A robotic fish comprising a torque reaction engine inside an isolation capsule, a fore loop and an aft loop, wherein the fore loop and aft loop pull the isolation capsule fore and aft within a dive ring, wherein a length of cord may be subtracted from the fore loop and added to the rear loop to relocate the isolation capsule within the dive ring.

Example 36

A robotic fish comprising a torque reaction engine inside an isolation capsule, a fore loop and an aft loop, wherein the fore loop and the aft loop pass through a center of the isolation capsule and, respectively, to a nose and a tail of the robotic fish and wherein the fore loop and aft loop are rotated in opposite directions to bend the nose and the tail to thereby steer the robotic fish.

The invention claimed is:

1. A robotic fish comprising a torque reaction engine within a capsule within a dive ring, wherein the capsule relocates within the dive ring to cause the robotic fish to dive and surface, and wherein the capsule is held in place within the dive ring by a pawl.

2. The robotic fish according to claim 1, wherein the dive ring is secured to one or more of a nose plate and a tail plate.

3. The robotic fish according to claim 2, wherein the nose and tail plates are flexible.

4. The robotic fish according to claim 2, wherein one of the nose and tail plates are secured to a fin.

5. The robotic fish according to claim 4, wherein a flexure of the fin is adjustable.

6. A robotic fish comprising a torque reaction engine within a capsule within a dive ring, wherein the dive ring is secured to one or more of a nose plate and a tail plate, wherein one of the nose and tail plates are secured to a fin, and wherein ends of the nose and tail plates are secured by cords.

7. The robotic fish according to claim 6, wherein the cords expand on a first side of the robotic fish and contract on a second side of the robotic fish.

8. The robotic fish according to claim 7, wherein expansion and contraction of the cords bends at least one of the nose or the tail plate.

9. The robotic fish according to claim 7, wherein the cords comprise an expansion-contraction joint.

10. The robotic fish according to claim 9, wherein the expansion-contraction joint receives a power input and wherein the power input causes the cords to expand on a first side of the robotic fish and contract on a second side of the robotic fish.

11. The robotic fish according to claim 10, wherein the expansion-contraction joint is secured to a power transfer media and wherein the power transfer media transfers the power input to the expansion-contraction joint from a steering power source.

12. The robotic fish according to claim 11, wherein the power transfer media is one of a fluid, a wire, and a solid bar.

13. A robotic fish comprising a torque reaction engine within a capsule within a dive ring, wherein the robotic fish further comprises a harness, wherein the harness allows a human to hold the robotic fish.

14. The robotic fish according to claim 13, wherein the harness allows the human to hold the robotic fish between a pair of legs of the human.

15. The robotic fish according to claim 13, wherein the harness is held from behind, relative to the robotic fish and a normal direction of travel.

16. The robotic fish according to claim 13, wherein the harness comprises a power transfer media and wherein the power transfer media transfers a power input to an expansion-contraction joint from a steering power source.

17. The robotic fish according to claim 16, wherein the steering power source is one of a human, a hydraulic engine, an electric engine, a solenoid, a linear engine.

* * * * *